US005715947A

United States Patent [19]

Gonzales

[11] Patent Number: 5,715,947

[45] Date of Patent: Feb. 10, 1998

[54] APPARATUS FOR STORING AND DISPLAYING GOLF BALLS

[76] Inventor: Andres Joe Gonzales, 2993 S. 400 E., Bouutiful, Utah 84010

[21] Appl. No.: 565,928

[22] Filed: Dec. 1, 1995

[51] Int. Cl.[6] ..... A47F 7/00

[52] U.S. Cl. ..... 211/14

[58] Field of Search ..... 211/19, 15, 128.1, 211/85.4, 85.7; D6/455, 468, 552, 471; D21/206, 208; 206/315.9

[56] References Cited

U.S. PATENT DOCUMENTS

| | | | |
|---|---|---|---|
| D. 121,485 | 7/1940 | Spánel | D6/468 X |
| D. 151,343 | 10/1948 | Greger | D6/468 X |
| D. 373,867 | 9/1996 | Rask | D6/552 X |
| 1,201,441 | 10/1916 | Clinger | 211/14 |
| 1,645,399 | 10/1927 | Pontikis | 211/14 X |
| 2,551,354 | 5/1951 | Wasilevich | 206/315.9 |
| 3,047,140 | 7/1962 | Robins | 206/315.9 |
| 3,604,705 | 9/1971 | Hawthorne | 211/14 X |
| 4,103,773 | 8/1978 | Haber | 211/14 X |
| 4,573,586 | 3/1986 | Helmer | 211/14 |
| 4,892,197 | 1/1990 | Slattery et al. | 211/194 X |
| 4,955,485 | 9/1990 | Alton | 211/14 |
| 5,381,895 | 1/1995 | Thomsen | 206/315.9 |
| 5,551,832 | 9/1996 | Kelly | 206/315.9 X |

*Primary Examiner*—Alvin C. Chin-Shue
*Assistant Examiner*—Sarah L. Purol
*Attorney, Agent, or Firm*—Thorpe, North & Western, L.L.P.

[57] ABSTRACT

The present invention concerns a display case for storing and displaying golf balls. The display case is in the shape of a pyramid. When displayed with golf balls, the inside structure, which is the upper support surface that is connected to the support base and mounts the golf balls, also has the appearance of a pyramid thereon.

The upper support surface that is attached to the support base of the storage and display case, includes a plurality of members of different lengths separately arranged and mounted in a vertical fashion representing a pyramid, each member supports each golf ball. The upper support surface is enclosed by a transparent cover that is also the shape of a pyramid and is removable from the top, to place or retrieve the golf balls therein. The support base is the bottom that supports the storage and display case.

The storage and display case, by its simple design and attractive appearance, is considered a sculptured work of art and collectors item by the golf ball collection that it displays. The golf balls are mounted in a descending order from top to bottom, which may be arranged to one's own personal preference or valued importance. The golf ball storage and display case is easily displayed in the middle of a room, on a office desk, a display table, an end table, or in a trophy cabinet.

13 Claims, 2 Drawing Sheets

APPARATUS FOR STORING AND DISPLAYING GOLF BALLS

THE BACKGROUND OF THE INVENTION

Golfing is a sport that is taken up by many people. It's unique personal challenges create memories and a personal attachment to many of its articles. The collection of golf balls is a way one commemorates their love for the game. A golf ball collection may be of famous courses, history of the courses that one has played, special hole in one golf balls, and balls that won a tournament. In response to this desire to collect golf balls, one needs an attractive storage and display case for their collection.

Various types of displays racks and display stands have been created. Some display racks are wooden that mount on the wall and have horizontally oriented dividers in which the golf ball rests on a golf tee. Other types of display racks have a vertically oriented body that stacks the golf balls in vertical slots, one on top of the other, this also mounts on the wall. This particular rack can physically mark and rub off the desired logos on the golf balls because they are stacked on each other and rubbing against one another. However, these types of displays are not an efficient use of display space, and many homes and offices do not allow wall space for golf items. Also, when mounted on a wall the mounts may damage the wall.

Another golf ball display device that has been created, is a display stand that appears like a giant golf ball and mounts the golf balls on assembled plates. The plates are arranged in a stacked fashion, one on top of the other, and the balls are mounted and separated by recesses cut out of the plate in the shape of a golf ball. Again, the golf ball logos may be damaged as they are rubbed against each other and against the plates.

In view of the above, none of these displays consider all the important factors needed to store and display golf balls in a attractive, secure, and space efficient manner. The main focus is the collection of golf balls. They must present well, present by means not to cause destruction to other property, and most of all, present in a way not to damage the golf ball logos.

OBJECTS AND SUMMARY OF THE INVENTION

The present invention is directed to a golf ball storage and display case for collectors who collect golf balls from famous courses, history of the courses that one has played, special hole in one golf balls, and balls that won a tournament, in an attractive, secure, and space efficient manner.

The principle object of the present invention is to provide a display case for storing and displaying golf balls. The golf ball storage and display case has a transparent cover that resembles the shape of a pyramid. When displayed with golf balls, the upper support surface which is connected to the support base, that mounts each golf ball with vertical support members aligned in a descending order, also resembles the shape of a pyramid thereon.

It is an additional object of the invention to provide a storage and display case that is attractive in appearance. The simple design makes this a unique work of art, that can be used as a collectors item. The pyramid design provides enhanced viewing of each golf ball from all angles.

It is a yet an additional object of the invention to provide a storage and display case that allows easy accessibility of each golf ball, allowing the placement or removal of a single ball without tampering any other ball, thus no chance for possible damage to the desired logos.

It is still an additional object of the invention to provide a storage and display case that provides security for the golf ball collection. The transparent cover seals and encloses the golf ball collection which prohibits dust and curious fingers from handling the collection.

It is another object of the invention to provide a storage and display case that displays in a space efficient manner. The pyramid design presents like a sculpture, in that it may display in the middle of a room, on a office desk, a display table, an end table, or in a trophy cabinet. No wall space needed, no destruction to walls, no reason not to display your collection.

It is yet another object of the invention to provide a storage and display case that maximizes the number of golf balls displayed in a particular area. This is done by the pyramid design of the upper support surface, the design displays golf balls on all sides of the display case in a descending order from top to bottom, thus uses a large proportion of the inside space of the pyramid shaped transparent cover.

It is also an object of the invention to provide a storage and display case that can be easily modified to a particular size regarding the desired amount of golf balls displayed, a maximum or minimum number of golf balls can be displayed.

It is a further object of the invention to provide a storage and display case that is light weight and relatively inexpensive. The material may be of plastic fabrication, which is light weight and can be easily produced. It's simple design requires no assembly or instructions. The display case arrives ready for use.

In summary, the main object of the present invention is to provide a display case for storing and displaying golf balls. The golf ball storage and display case has a transparent cover that resembles the shape of a pyramid. When displayed with golf balls, the upper support surface which is connected to the support base, that mounts each golf ball with vertical support members aligned in a descending order also resembles the shape of a pyramid thereon.

BRIEF DESCRIPTION OF THE DRAWINGS

The above and other objects, features and advantages of the invention will become apparent from a consideration of the subsequent detailed description presented in connection with the accompanying drawing in which.

DETAILED DESCRIPTION

Figure 1A:
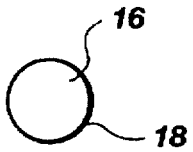
FIG. 1A is a plan view of one of the support members of FIG. 1.
Figure 1:
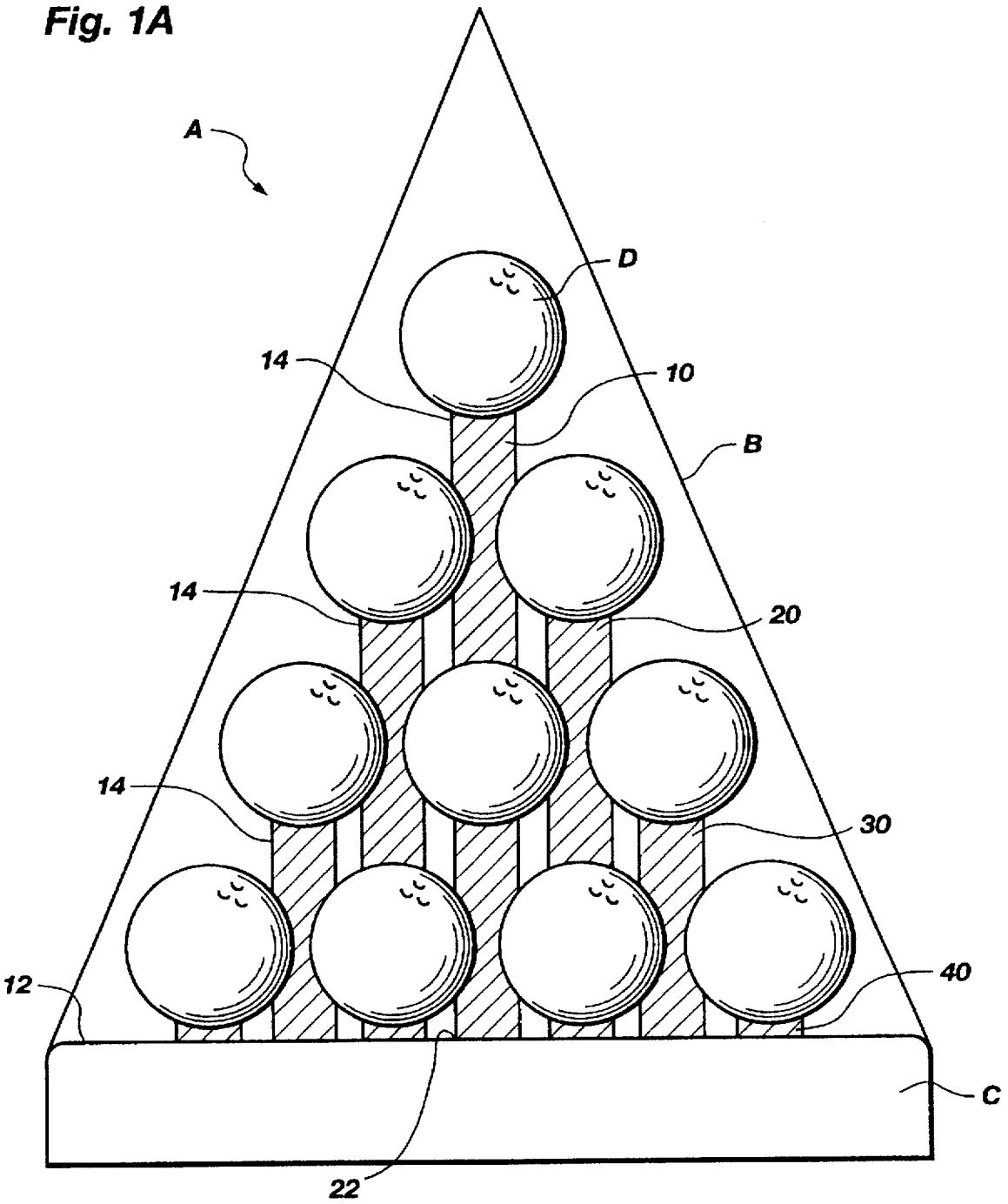
FIG. 1 is a overall view of the storage and display case of the present invention, with golf balls mounted on their supportive members. All sides of the display case appears identical to each other, except the different golf balls displayed.
Figure 2:
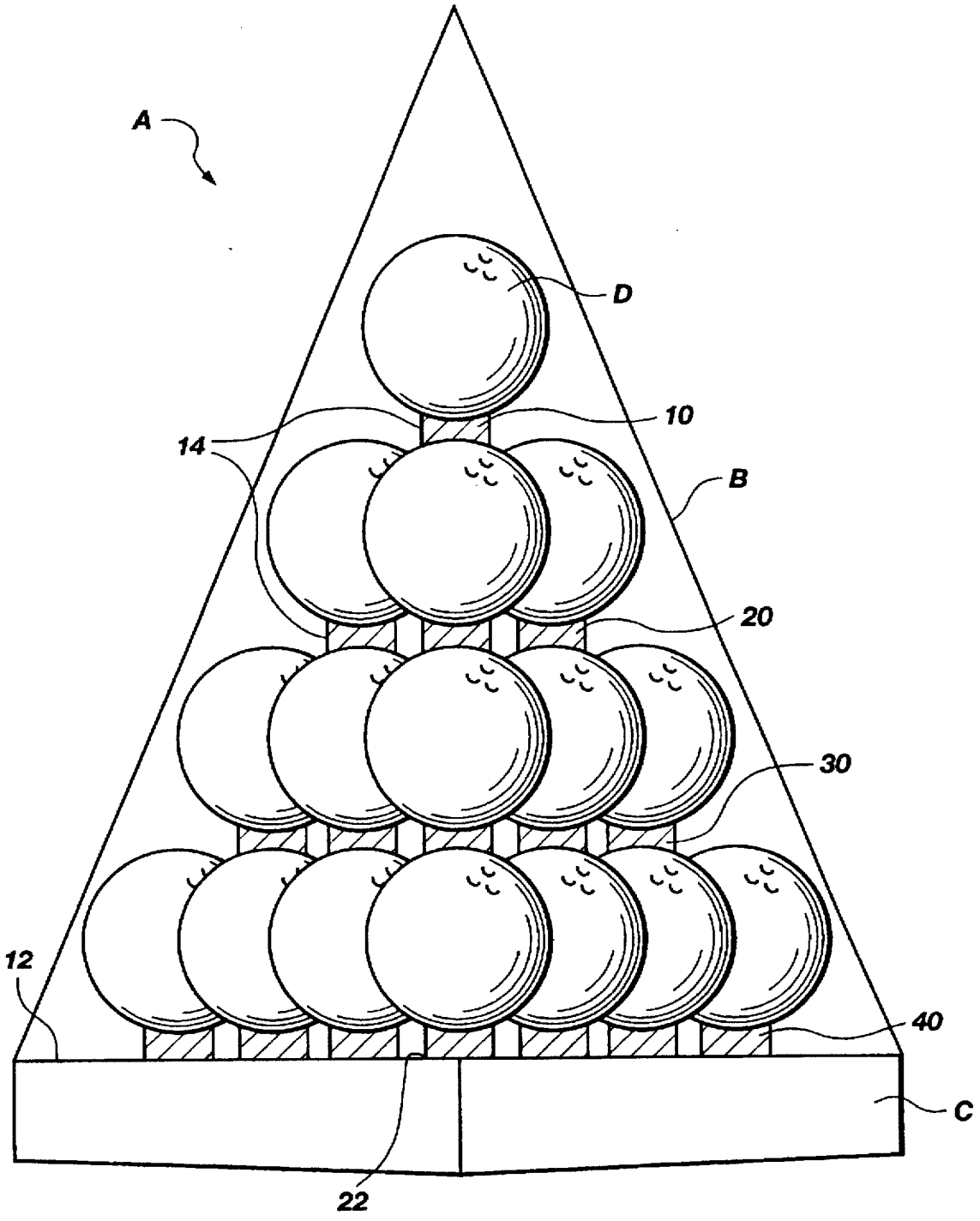
FIG. 2 is a cross sectional view of the storage and display case of the invention with the golf balls mounted on their supportive members of FIG. 1. As shown, the golf balls are mounted on vertical support members and aligned in a descending order from top to bottom.

The display case made in accordance with the present invention generally indicated in FIG. 1 and FIG. 2 as A, includes a generally outer upper section B, supported on top of the upper support surface which is connected to the support base, section C. As seen in FIG. 1 and FIG. 2, outer upper section B, has the appearance of a pyramid and the upper support surface, section C, when mounted with spherical objects, section D, also has the appearance of a pyramid thereon.

As can be seen in FIG. 1 and FIG. 2, the outer upper section B, is made of a transparent cover that resembles the shape of a pyramid. The transparent display cover section B, is positioned and removed from the top, and is supported on base section C. The base section C includes a suitable support surface 12 for sustaining support members 10, 20, 30 and 40 thereon. Since the outer upper section B is removably positioned on base section C, the spherical objects D can be repositioned and replaced if desired. This provides additional viewing and enhances the visibility of the spherical objects, section D, from all sides of the display case.

As clearly shown in FIG. 1 and FIG. 2, the upper support surface that is connected to the base, section C, is made from a plurality of vertical mounted support members 10, 20, 30, and 40, that are arranged in a descending order that is in the shape of a pyramid. The support members 10, 20, 30 and 40, are generally tubular in shape and are of different lengths. More particularly, the center support member 10, is the largest at length of all the support members, and the support members 20, is a measurement length less than support member 10, which continues to descend with support members 30, being less length than 20, and support members 40, the least length of all support members. In other word, the vertical mounted support members decline by their lengths at a slope which resembles a pyramid. It should be noted that though only four different lengths of vertical mounted support members are shown herein, it is well within the scope of this invention to vary the number of support members thereof, in order to obtain storage and display cases of varying sizes to meet the desire of the needs.

As best seen in FIG. 1 and FIG. 2, the spherical objects, section D, that are mounted on top of the vertical mounted support members 10, 20, 30, and 40, are golf balls, the vertical mounted support members are large enough in width to securely support each golf ball.

As shown in FIGS. 1–2, the support members 10, 20, 30 and 40 are coupled to the support surface 12 and extend upwardly therefrom, terminating in mounting ends 14. Referring now to FIG. 1A, since the support members 10, 20, 30 and 40 are tubular, each mounting end 14 includes a concave recess 16 (such as an open recess defining a channel formed at the end of an open tube, or any suitable concave recess) formed therein, with at least one support edge 18 surrounding the concave recess 16. As such, the item 16 recess may alternatively comprise a solid wall defining a concavity bounded by the support edge 18. The support edge 18 is configured and dimensioned for receiving a spherical object D, such as a golf ball, thereon such that said spherical object D extends into the open recess 16.

To use the golf ball storage and display case A, the user removes from the top, the transparent cover, the outer upper section B, from the support base section C. The user then places or removes spherical objects, in this case golf balls, section D, from one or more selected support member 10, 20, 30 and 40 as desired, then replaces the transparent cover, section B. The golf ball storage and display case A, can be placed in the middle of a room, on a office desk, a display table, an end table, or in a trophy cabinet.

As shown in FIGS. 1–2, the transparent, pyramid-shaped cover B covers the support members 10, 20, 30 and 40 and the spherical objects D displayed thereon, without contacting said support members and objects. As such, the transparent cover B constitutes a transparent, pyramid-shaped cover means releasably attachable to the support base C for covering the support members 10, 20, 30 and 40 and any objects displayed on said support members without contacting said support members and objects. Since the spherical objects D are to be arranged in a pyramidal configuration, the support members 10, 20, 30 and 40 are therefore arranged in a non-circular orientation.

FIGS. 1–2 illustration that the support base C includes a geometric center 22, as do all tangible objects. The geometric center 22 comprises a center portion of the support base C in at least one horizontal dimension as shown in FIGS. 1–2. The support member 10 thus comprises a central support member coupled to said geometric center 22 of the support base C, said central support member 10 being longer than all other support members 20, 30 and 40, to enable display of the spherical objects D in a pyramidal configuration with a highest-positioned spherical object received upon said central support member 10. As shown in FIGS. 1–2, the support members 10, 20, 30 and 40 are positioned and arranged such that standard-sized golf balls (spherical objects D) received on the support members reside out of contact with each other.

It should be noted that the present invention shown in FIG. 1 and FIG. 2, section A, generally may be made of a light-weight material, such as plastic fabrication material. The outer upper section B, must be transparent for viewing purposes. The support base section C, with the upper support surface that is made from a plurality of vertical mounted support members 10, 20, 30, and 40, may be made of a plastic fabrication material that is transparent, translucent, or opaque, and may be colored for aesthetics.

In view of the above disclosure, a preferred method for displaying spherical objects comprises the steps of:

(a) coupling at least one support member to a support base such that said support member extends upwardly from said support base and terminates in a concave recess defined by a support edge;

(b) placing a spherical object upon the support edge;

(c) releasably attaching a transparent, pyramid-shaped cover means to the support base for covering the support member and spherical object without contact said support member and spherical object, to thereby enable said spherical object to be viewed through said transparent cover.

As can be seen from the above, the display case A, of the present invention needs not to be assembled and needs no instructions for use. It's simple design not only make it a useful storage and display case, but an attractive and unique work of art. While this invention has been described to have a preferred design, it is understood that it is capable of further modifications, uses and/or adaptations of the invention and following in general the principle of the invention and including such departures from the present disclosure as have come within the known or customary practice in the art to which the invention pertains, and as may be applied to the central features hereinbefore set forth, and fall within the scope of the invention or limits of the claims appended hereto.

What is claimed is:

1. Art apparatus for supporting and displaying spherical objects comprising:

(a) a support base having an upper support surface;

(b) a plurality of elongate support members coupled to the support surface and extending upwardly therefrom, said support members terminating in mounting ends, each mounting end having a concave recess formed therein and at least one support edge surrounding said concave recess, said support edge being configured and dimensioned for receiving a spherical object thereon such that said spherical object extends into the concave recess; and (c) a transparent, pyramid-shaped cover means releasably attachable to the support base for covering the support members and any objects displayed on said support members without contacting said support members and objects, to thereby enable said spherical objects to be viewed through said transparent cover.

2. The apparatus as defined in claim 1, further comprising:

(a) said transparent cover made of a plastic fabrication material.

3. The apparatus as defined in claim 1, further comprising:

(a) said support surface and support members made of a plastic fabrication material.

4. The apparatus as defined in claim 1, further comprising:

(a) said support members extending upwardly vertical to mount each spherical object thereon;

(b) said support members being of different lengths;

(c) said support members arranged by lengths in a descending order;

(d) said support members coupled to support surface.

5. The apparatus as defined in claim 1, further comprising:

(a) said support members when arranged by lengths in a descending order such that when displayed with spherical objects is generally pyramid in shape thereon.

6. The apparatus as defined in claim 1, further comprising:

(a) said spherical objects are golf balls.

7. The apparatus as defined in claim 1, further comprising:

(a) a transparent cover means for enclosing the support members by releasing and attaching to the support base;

(b) said transparent cover means generally the shape of the upper support surface with the support members of the display devise that mounts the spherical objects thereon will have the identical shape and appearance thereon;

(c) said transparent cover means for securing the upper section support surface.

8. The apparatus as defined in claim 7, further comprising:

(a) said transparent cover means generally pyramid in shape.

9. The apparatus as defined in claim 1, wherein the elongate support members are positioned and arranged such that standard-sized golf balls received on the support members reside out of contact with each other.

10. The apparatus as defined in claim 1, wherein the support base includes a geometric center, and wherein one of said support members comprises a central support member coupled to said gemometric center of the support base, said central support member being longer than all other support members, to enable display of the spherical objects in a pyramidal configuration with a highest-positioned spherical object received upon said one of said support members.

11. An apparatus for supporting and displaying spherical objects comprising:

(a) a support base having an upper support surface and a geometric center;

(b) at least one elongate support member coupled to the geometric center of the support surface and extending upwardly therefrom, said support member terminating in a mounting end having a concave recess formed therein and at least one support edge surrounding said concave recess, said support edge being configured and dimensioned for receiving a spherical object thereon such that said spherical object extends into the concave recess; and (c) a transparent, pyramid-shaped cover means releasably attachable to the support base for covering the support member and any object displayed on said support member without contacting said support member and object, to thereby enable said spherical object to be viewed through said transparent cover.

12. An apparatus for supporting and displaying spherical objects comprising:

(a) a support base having an upper support surface;

(b) a plurality of elongate support members coupled to the support surface and extending upwardly therefrom, said support members terminating in mounting ends, each mounting end having a concave recess formed therein and at least one support edge surrounding said concave recess, said support edge being configured and dimensioned for receiving a spherical object thereon such that said spherical object extends into the concave recess; and (c) a transparent, pyramid-shaped cover means releasably attachable to the support base for covering the support members and any objects displayed on said support members without contacting said support members and objects, to thereby enable said spherical objects to be viewed through said transparent cover;

wherein the elongate support members are positioned and arranged such that standard-sized golf balls received on the support members reside out of contact with each other; wherein the support base includes a geometric center, and wherein one of said support members comprises a central support member coupled to said geometric center of the support base, said central support member being longer than all other support members, to enable display of the spherical objects in a pyramidal configuration with a highest-positioned spherical object received upon said one of said support members;

wherein the support members are arranged in a non-circular orientation to enable the spherical objects to be displayed in a pyramidal orientation.

13. A method for displaying spherical objects, said method comprising the steps of:

(a) coupling at least one support member to a support base such that said support member extends upwardly from said support base and terminates in a concave recess defined by a support edge;

(b) placing a spherical object upon the support edge;

(c) releasably attaching a transparent, pyramid-shaped cover means to the support base for covering the support member and spherical object without contacting said support member and spherical object, to thereby enable said spherical object to be viewed through said transparent cover.

* * * * *